United States Patent [19]

Knauer et al.

[11] 4,026,474

[45] May 31, 1977

[54] VENTURI NOZZLE FOR AIR GUNS

[75] Inventors: Ralph H. Knauer, Clifton; William R. Rohrbach, Lincoln Park, both of N.J.

[73] Assignee: Western Electric Company, Inc., New York, N.Y.

[22] Filed: Jan. 22, 1976

[21] Appl. No.: 651,383

[52] U.S. Cl. ..... 239/430; 239/433; 239/DIG. 22

[51] Int. Cl.[2] ..... B05B 7/30

[58] Field of Search ..... 239/DIG. 21, DIG. 22, 239/291, 296, 419.5, 428.5, 425.5, 430, 433, 601, 589, 429

[56] References Cited

UNITED STATES PATENTS

| | | | |
|---|---|---|---|
| 1,660,557 | 2/1928 | Heimburger | 239/589 X |
| 2,548,725 | 4/1951 | Justis | 239/428.5 X |
| 3,445,069 | 5/1969 | Druge | 239/433 X |
| 3,498,545 | 3/1970 | Short | 239/430 X |
| 3,620,457 | 11/1971 | Pearson | 239/601 X |
| 3,708,125 | 1/1973 | Patterson | 239/428.5 |
| 3,774,847 | 11/1973 | Malec | 239/DIG. 22 |
| 3,790,084 | 2/1974 | Kinsley | 239/291 |
| 3,799,450 | 3/1974 | Braukman | 239/428.5 |
| 3,801,020 | 4/1974 | Mocarski | 239/433 X |

FOREIGN PATENTS OR APPLICATIONS

| | | | |
|---|---|---|---|
| 17,997 | 1895 | United Kingdom | 239/430 |
| 27,086 | 1896 | United Kingdom | 239/430 |
| 14,250 | 1901 | United Kingdom | 239/419.5 |
| 247,839 | 2/1926 | United Kingdom | 239/428.5 |

*Primary Examiner*—Evon C. Blunk
*Assistant Examiner*—Andres Kashnikow
*Attorney, Agent, or Firm*—R. A. Lloyd; J. J. Kissane

[57] ABSTRACT

A venturi nozzle for air guns includes an elongated, cylindrically shaped tube having a restricted orifice in a compressed air receiving end thereof through which compressed air is passed into a discharge end thereof. The air flow area of the discharge end of the tube is greater than the air flow area of the orifice to allow expansion of the air exiting the orifice in a region of the discharge end of the tube adjacent the orifice. Apertures formed through the tube in the discharge end thereof adjacent the orifice permit ambient air to be drawn by venturi effect into the tube and to be discharged with the expanded air out of the discharge end of the tube. It has been discovered that when the apertures are positioned around the circumference of the tube at nondiametrically opposed positions, and have a length along the axis of the tube which is greater than the width of the apertures around the circumference of the tube, the volume of air output from the discharge end of the nozzle is maximized for a given volume of compressed air input to the receiving end of the nozzle. Furthermore, it has also been found that when the ends of the apertures along the lengths thereof are tapered at an acute angle relative to the axis of the tube toward the receiving end thereof, the volume of air output from the discharge end of the nozzle is further maximized and the noise generated by air passing through the nozzle is minimized.

7 Claims, 4 Drawing Figures

16
12
36
64
60
28
32
20
24
22
38
40
44
3
72
68
54
52
55
53
56
48

VENTURI NOZZLE FOR AIR GUNS

BACKGROUND OF THE INVENTION

1. Field of the Invention

The present invention relates to nozzles for air guns, and in particular to a venturi nozzle for an air gun which maximizes the volume of air discharged from the nozzle for a given volume of compressed air input thereto, and which minimizes the noise generated by the nozzle upon the passage of air therethrough.

2. Description of the Prior Art

In the manufacture and maintenance of various types of equipment, air guns are often employed to blow dust and other debris from the equipment. Air guns ordinarily operate with an input air pressure greater than 40 psi. However, as a result of one standard promulgated under the Occupational Safety and Health Act (OSHA), the maximum pressure generated at an air gun nozzle discharge tip when the nozzle is dead ended, such as by being placed against an operator's hand or a flat surface, must be less than 30 psi.

A known nozzle for alleviating the problem of dead ended pressure build up includes a restricted orifice within a central bore of the nozzle through which compressed air passes into a discharge end of the nozzle, and a plurality of circular apertures formed through the nozzle in the discharge end thereof. When the discharge end of the nozzle is dead ended, the compressed air therewithin passes through the circular apertures, or vent holes, to limit build up of pressure within the discharge end of the nozzle. As set forth in U.S Pat. No. 3,790,085, with this type of nozzle the vent holes are desirably located adjacent the restricted orifice so that when air is passed through the orifice an additional volume of air is aspirated into the main stream of air in the discharge end of the nozzle because of the venturi effect produced within the discharge end of the nozzle adjacent the orifice by the passage of the compressed air therethrough. In this manner, the vent holes not only allow trapped air to travel outward therethrough to reduce the pressure within the discharge end of the nozzle should the discharge end be blocked, but they also allow air to be drawn therethrough into the stream of air within the discharge end of the nozzle when the end of the nozzle is not blocked.

Moreover, in many instances, the compressors available to supply compressed air to guns are limited in capacity, resulting either in the inability to supply air continuously to any one air gun, or in the inability to simultaneously operate several air guns. While previous venturi nozzles have operated to increase the volume of air discharged from the exhaust hole of the nozzle for a given volume of compressed air input to the nozzle from the air gun, the increased obtained has not been of sufficient magnitude to permit satisfactory and efficient use of limited capacity compressors. It is, therefore, desirable that the design of the vented nozzle be such as to maximize the volume of air discharged therefrom for a given volume of compressed air input thereto.

SUMMARY OF THE INVENTION

In accordance with the present invention, a venturi fluid discharge nozzle includes an elongated, cylindrically shaped tube having a restricted orifice formed adjacent a fluid receiving end thereof through which a compressed gaseous fluid is passed into a fluid discharge end thereof. The fluid flow area of the discharge end of the tube is greater than the fluid flow area of the orifice to allow expansion of the fluid passed through the orifice in a region of the discharge end of the tube adjacent the orifice, and a plurality of nondiametrically opposed elongated apertures (i.e., a plurality of apertures each having a length along the axis of the tube which is greater than the width of the aperture along the circumference of the tube) are formed through the tube along the length thereof from a point adjacent the restricted orifice to a point toward the discharge end of the tube to permit ambient gaseous fluid adjacent the exterior of the tube to be drawn by venturi effect through the aperture into the tube and discharged with the expanded fluid out of the discharge end of the tube.

Preferably, three elongated apertures are formed through the tube at 120° increments around the periphery of the tube which is in reality a venturi tube defined by a pair of internal truncated conical surfaces which have their small ends joined by a short cylindrical surface or venturi throat. The elongated apertures are located adjacent the dischage end of the venturi throat and extend into the truncated surfaces on the discharge side of the throat. Both end surfaces are tapered in the same general direction so as to extend from the internal surface of the tube back toward the receiving end of the tube.

The discharge nozzle of this invention is particularly suitable for use in a gas discharge system having a source of limited capacity, e.g., a portable air compressor, in view of the fact that the nozzle substantially increases the volume of air output for a given volume of compressed air input to the nozzle relative to prior nozzles having circular apertures therein.

DETAILED DESCRIPTION

Figures 1, 2, 3:
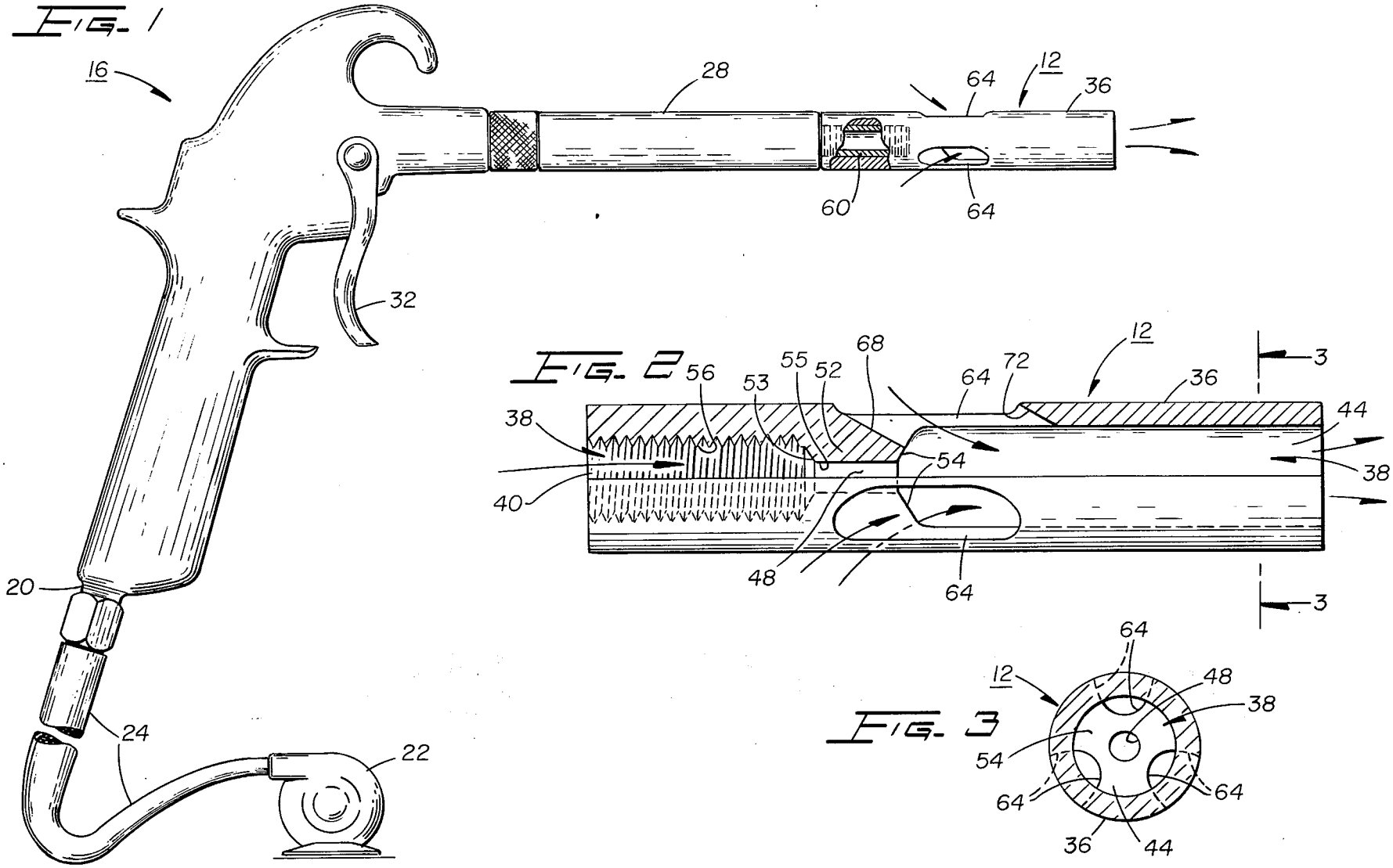
FIG. 1 illustrates, partially in cross-section, the nozzle of the invention secured to a conventional air gun.
FIG. 2 is a quarter-sectional view of the nozzle shown in FIG. 1.
FIG. 3 is an end view of the discharge end of the nozzle.

Referring to FIG. 1, a nozzle 12 structured in accordance with the teachings of the invention for having a gaseous fluid, such as air, passed therethrough, is shown connected to a conventional air gun 16 of a type which includes an inlet 20 thereto for receiving compressed air from a source of compressed air (shown in the figure as air tank 22) through an air line 24, an outlet 28 for interconnecting with the nozzle 12, and a trigger 32 which may be selectively actuated by an operator to pass compressed air from the inlet 20 to the outlet 28. As can be more clearly seen from FIG. 2, the nozzle 12 is formed from an elongated, cylindrically shaped tube 36 having a bore 38 extending therethrough which defines a compressed fluid, or compressed air, receiving passageway 40 at one end of the nozzle, a fluid, or air, discharge passageway 44 at an opposite end of the nozzle, and a restricted orifice or throat 48, defined by a pair of inclined, inwardly extending wall sections 52, within the compressed air receiving passageway 40 and between the passageway 40 and the air discharge passageway 44. In effect, a venturi tube is provided having an internal surface consisting of two oppositely disposed truncated core surfaces 53 and 54 connected at their small ends by a short cylindrical surface 55 defining the throat 48. Threads 56 are circumferentially formed within the air receiving passageway 40 to allow the nozzle 12 to communicate with the air gun 16 by being threaded onto mating threads 60 formed around the outlet 28 of the air gun.

A plurality of nondiameterically opposed elongated openings, or apertures 64, are formed through the tube 36 around the periphery thereof, to extend through a portion of the core surface 54 at a point adjacent the restricted orifice 48 in the air discharge end 44 of the tube, and have a length along the axis of the tube which is greater than a width around the circumference of the tube. In a preferred embodiment of the invention, and as shown, three apertures are formed through the tube 36 at 120° increments around the periphery thereof.

As best shown in FIG. 3, the cross-sectional, or air flow area of the orifice 48 is less than the cross-sectional, or air flow area of the air discharge passageway 44. With this design, the nozzle 12 takes advantage of the venturi principle in which fluid velocity is increased as it passes a restriction in a tube causing a reduced pressure or vacuum in that portion of the tube. In other words (and with reference to FIG. 2), as compressed air provided by the air gun passes through the air receiving passageway 40 and the restricted orifice 48 and into the air discharge passageway 44, a reduction in pressure results which aspirates, or draws, ambient air through the apertures 64 and into the discharge passageway 44, as shown by the arrows extending through the aperture 64, for discharge from the passageway 44 combined with the compressed air. This increases the volume of air discharged from the passageway 44 of the nozzle 12, so that the total volume of air discharged from the nozzle is greater than the volume of air input thereto from the air gun 16. Besides increasing the volume of air discharged from the nozzle 12, it should be noted that the apertures 64 provide passageways, or vents, for the release of air in the event the discharge passageway 44 is dead ended to reduce the maximum pressure build up within the passageway 44 to a safe level in accordance with OSHA requirements. Furthermore, it should be noted that by positioning the apertures 64 at nondiametrically opposed positions around the periphery of the tube, ambient air entering through each aperture is not directly opposed by, or confronted with, ambient air from an opposite aperture, which increases the total volume of ambient air drawn into the nozzle and, therefore, the total volume of ambient air discharged from the nozzle, for a given volume of air input thereto from the air gun 16.

To minimize noise generated within the nozzle 12 as a result of the passage of air therethrough, and to further increase the volume of ambient air drawn through each aperture 64 by enhancing the smoothness of the flow therethrough, the end of each aperture closest to the restricted orifice 48 is formed with a tapered surface 68 which extends through a portion of the core surface 54 and terminates adjacent the restricted orifice 48 within the air discharge passageway 44 of the nozzle 12, and which forms an acute angle relative to the axis of the tube toward the air receiving passageway 40 thereof. Similarly, the end of each aperture farthest from the restricted orifice 48, or closest to the outlet end of the discharge passageway 44, is formed with a tapered surface 72 which forms an acute angle relative to the axis of the tube toward the air receiving passageway 40 thereof. Preferably, the angle between the surfaces 68 and 72 and and the axis of the tube 36 is between 25° and 45° with optimum results being obtained at approximately 30°. The sloping surfaces 68 and 72 provide air paths which reduce the noise generated by the passage of air through the nozzle because a more laminar, or less turbulent, flow is imparted to the ambient air being drawn into the nozzle by the venturi effect, and further increases the volume of ambient air drawn into the nozzle by reducing the resistance to the flow of ambient air through the apertures.

In general, for restricted surfaces between 1/16 inch and ⅛ inch, a maximum force was obtained with aperture lengths in excess of ½ inch for a 2½ inch nozzle having an air discharge passageway approximately 1½ inches in length and 11/32 inches in diameter. The force was not found to vary appreciably for aperture lengths up to 1 inch for such nozzles.

Figure 4:
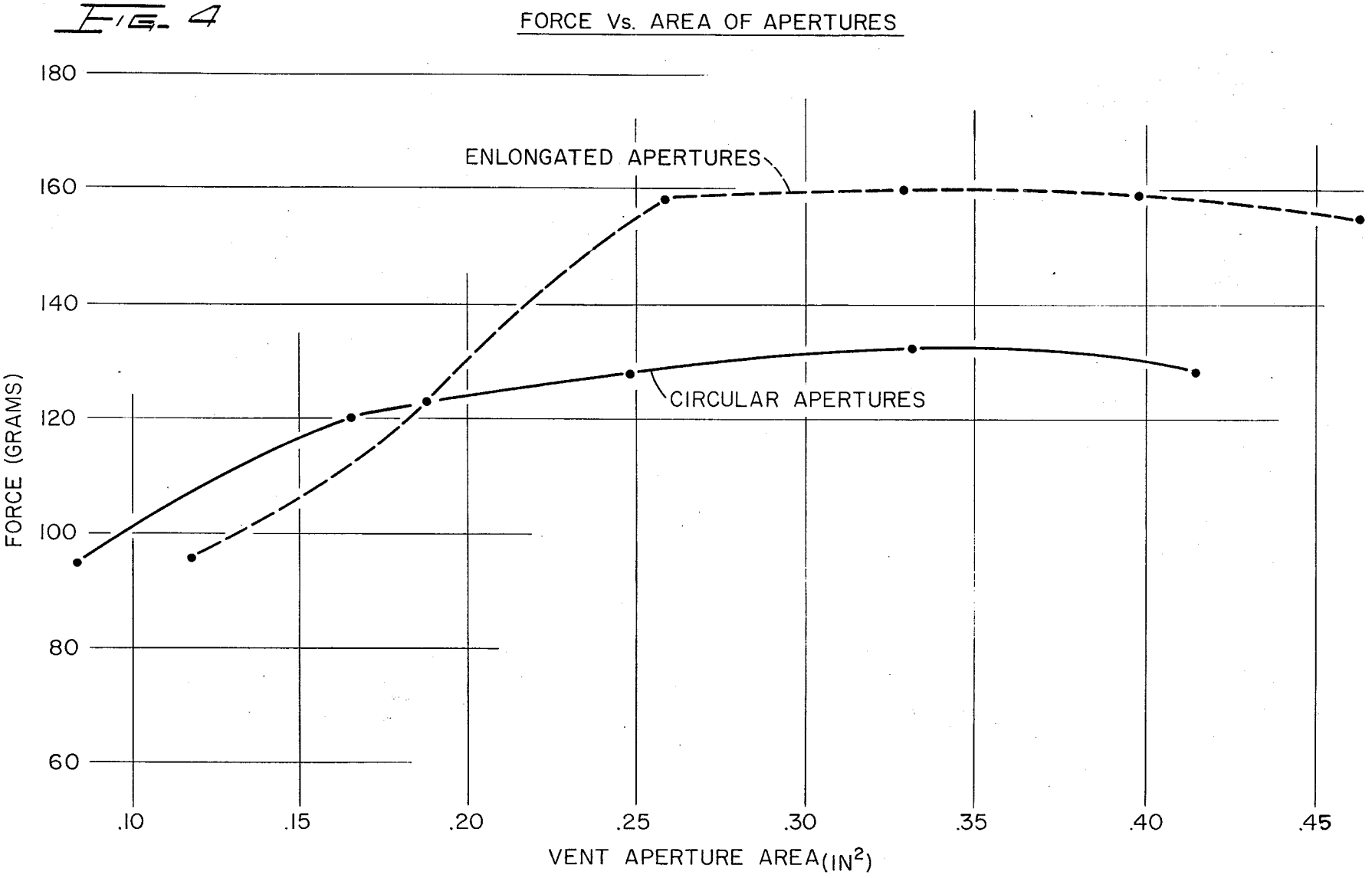
FIG. 4 is a graph comparing the forces exerted at the output of a nozzle having elongated apertures of given areas in accordance with the teachings of the invention, as compared with a conventional nozzle having circular apertures with identical areas.

The nozzle 12, as described, with the elongated, tapered apertures which have a length along the axis of the nozzle greater than a width of the apertures around the circumference of the nozzle, and which are located at nondiametrically opposed positions around the periphery of the nozzle in the discharge end thereof adjacent the restricted orifice, maximizes the volume of air discharged from the nozzle, for a given volume of compressed air input thereto, as compared with conventional prior art nozzles having circular, non-tapered venturi openings, which are normally positioned in opposition around the circumference of the nozzle. FIG. 4 shows the force exerted by the discharging air against a two inch diameter plate from a distance of two inches, both by nozzles having elongated, tapered venturi apertures in accordance with the teachings of the present invention, and by nozzles having conventional circular apertures, for various total nozzle aperture areas. The nozzles employed in making the measurements were structurally identical, except for the configuration of the apertures formed therein, and the pressure of the compressed air supplied to the nozzles was 40 psi in all cases. All the nozzles had a 3/32 inch orifice, and so the volume of compressed air per unit of time supplied to each nozzle was identical. For the nozzles with the elongated, tapered apertures having a length along the axis of the nozzles greater than the width of the apertures around the circumference of the nozzles, the apertures were positioned at 120° increments around the periphery of the nozzle in accordance with the teachings of the preferred embodiments of the invention. For the nozzles with conventional circular apertures, three rows of circular apertures were formed along the axis of the nozzle adjacent the restricted orifice at 120° increments around the periphery of the nozzle. The total area of the three elongated apertures was varied by changing the length of the apertures, and the total area of the three rows of circular apertures was varied by adding additional circular apertures to the rows of apertures.

Since the nozzles are identical except for the configuration of the apertures formed therein, the discharge force measured against the two inch diameter plate spaced two inches from the end of the nozzles is a function of the volume of air exhausted from the nozzles, and the greater the measured force the greater the volume of air discharged from the nozzle. And since the volume of compressed air input to each nozzle is the same per unit of time, the greater the measured force the greater the efficiency of the nozzle. That is, the greater the measured force the greater the volume of air discharged from the nozzle for a given volume of compressed air input thereto.

As shown in FIG. 4, the force exerted against the two inch diameter plate by nozzles with either elongated or circular apertures, and having the dimensions indicated on the Figure, increases with increasing venturi aperture area up to a maximum area of approximately 0.25 square inches, at which point the force becomes essentially constant. As is shown, for all practical and useful venturi aperture areas, the force exerted by the nozzles having the elongated, tapered apertures in accordance with the teachings of the invention is significantly greater than the force exerted by the nozzles having conventional circular apertures, for equal total cross-sectional areas of the apertures. In other words, the nozzles having the elongated, tapered apertures in accordance with the invention are considerably more efficient than the nozzles having the circular apertures, require less air input thereto for a given volume of air output therefrom, and may advantageously be employed where limited capacity compressed air facilities are available.

While one specific embodiment of the invention has been described in detail, it is understood that various other modifications and embodiments may be devised by one skilled in the art without departing from the spirit and scope of the invention.

What is claimed is:

1. In a venturi fluid discharge nozzle, an elongated, cylindrically shaped tube having a restricted orifice formed in a fluid receiving end thereof through which a compressed gaseous fluid is passed into a fluid discharge end thereof, the fluid flow area of the discharge end of the tube being greater than the fluid flow area of the orifice to allow expansion of the fluid exiting the orifice in a region of the discharge end of the tube adjacent the orifice, the tube having a plurality of elongated apertures situated at nondiametrically opposed positions around the periphery of the tube, each said aperture having a length along the axis of the tube which is greater than the width around the circumference of the tube, said apertures being formed through said tube along the length of the tube from a point adjacent the restricted orifice to a point toward the discharge end of the tube to permit ambient gaseous fluid adjacent the exterior of the tube to be drawn by venturi effect through the apertures and into the tube and discharged with the expanded fluid out of the discharge end of the tube.

2. In a venturi fluid discharge nozzle as set forth in claim 1 wherein the restricted orifice is established by a pair of opposed truncated cone surfaces connected at their small ends by a short cylindrical surface, and wherein the elongated aperture extends into the truncated cone surface facing the discharge end of said tube.

3. In a venturi fluid discharge nozzle as set forth in claim 2 wherein the end of the aperture closest to the receiving end of the tube is tapered to provide an end surface that forms an acute angle relative to the axis of the tube toward the receving end of the tube.

4. In a venturi fluid discharge nozzle as set forth in claim 3, wherein three apertures are around the periphery of the tube at 120° increments.

5. In a gas discharge system characterized by a limited capacity tank for compressed gas and a gun for controlling the discharged gas from the tank, an improved venturi fluid discharge nozzle for the gun, which comprises a cylindrically shaped tube having a bore for communicating at a gas receiving end thereof with the outlet of the gun, a restricted orifice formed within the bore, between the gas receiving end thereof and a gas discharge end thereof, through which orifice the compressed gas from the outlet of the gun is passed into the gas discharge end of the bore, the flow area of the discharge end of the bore being greater than the flow area of the orifice to allow expansion of the gas exiting the orifice in a region of the discharge end of the bore adjacent the orifice, the tube having a plurality of apertures formed therethrough at a point adjacent the restricted orifice to permit ambient gas adjacent the exterior of the tube to be drawn by venturi effect through the apertures and into the bore and discharged with the expanded gas out of the discharge end of the bore, said apertures being situated at nondiametrically opposed positions around the periphery of the tube, each said aperture having a length along the axis of the tube which is greater than the width of the aperture around the circumference of the tube.

6. A gas discharge system as set forth in claim 5, wherein the end of the aperture closest to the gas receiving end of the bore is tapered to terminate adjacent the restricted orifice within the bore and to form an acute angle relative to the axis of the tube toward the gas receiving end of the bore.

7. In a gas discharge system as set forth in claim 6, having three apertures spaced around the periphery of the tube at 120° increments and having the end of each aperture furthest from the fluid receiving end of the bore tapered to form an acute angle relative to the axis of the tube toward the fluid receiving end of the bore.

* * * * *